US008079814B1

(12) United States Patent
Liang

(10) Patent No.: US 8,079,814 B1
(45) Date of Patent: Dec. 20, 2011

(54) TURBINE BLADE WITH SERPENTINE FLOW COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 399 days.

(21) Appl. No.: 12/418,574

(22) Filed: Apr. 4, 2009

(51) Int. Cl.
*F01D 5/18* (2006.01)

(52) U.S. Cl. ..... 416/97 R; 415/115; 416/92; 416/96 R

(58) Field of Classification Search ..... 415/115; 416/92, 96 R, 97 R
See application file for complete search history.

(56) References Cited

U.S. PATENT DOCUMENTS 5,848,876 A * 12/1998 Tomita ..... 416/96 R
6,079,946 A * 6/2000 Suenaga et al. ..... 416/97 R
6,132,173 A * 10/2000 Tomita et al. ..... 416/96 R
6,402,471 B1 * 6/2002 Demers et al. ..... 416/97 R
2002/0098078 A1 * 7/2002 Beeck et al. ..... 415/1
2006/0056970 A1 * 3/2006 Jacala et al. ..... 416/97 R
2007/0177976 A1 * 8/2007 Cunha et al. ..... 416/97 R
2007/0201979 A1 * 8/2007 Veltre et al. ..... 416/97 R
2008/0019841 A1 * 1/2008 Cunha ..... 416/97 R

* cited by examiner

*Primary Examiner* — Asok Sarkar
(74) *Attorney, Agent, or Firm* — John Ryznic

(57) ABSTRACT

A turbine rotor blade with an airfoil cooling circuit and a platform cooling circuit formed integral with each other such that only one cooling flow is used. The airfoil cooling circuit includes a 5-pass aft flowing serpentine circuit with a first leg located adjacent to the leading edge region. The platform includes a mid section platform cooling circuit and an aft section platform cooling circuit. Cooling air from the second leg flows into the mid section platform cooling circuit and then into the third leg, turns at the blade tip and flows from the fourth leg into the aft section platform cooling circuit, and then into the fifth leg and up toward the blade tip. Cooling air from the fifth leg is bled off through rows of multiple impingement holes in the trailing edge and then discharged through exit holes or slots formed along the trailing edge.

16 Claims, 3 Drawing Sheets

TURBINE BLADE WITH SERPENTINE FLOW COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to an industrial gas turbine engine, and more specifically to a turbine rotor blade with integral platform and airfoil cooling.

2. Description of the Related Art Including Information Disclosed Under 37 CFR 1.97 and 1.98

A gas turbine engine includes a turbine with multiple rows or stages of rotor blades that react with a high temperature gas flow to produce mechanical power. In an industrial gas turbine (IGT) engine, this mechanical power is used to drive a compressor to supply pressurized air to the engine and to drive an electric generator for production of electrical power. The engine efficiency can be increased by passing a higher temperature gas flow into the turbine. However, the turbine inlet temperature is limited by the material properties of the turbine rotor blades and stator vanes, especially the first stage airfoils. Higher temperature resistant materials allow for turbine airfoils with increased operating temperatures.

Another way of allowing for higher turbine inlet temperatures is to provide more effective cooling of the airfoils. Either providing for more effective cooling of the cooling air flow through the airfoils, or by using less cooling air to provide the same amount of cooling would also increase the engine efficiency by wasting less compressed air. The compressed air used for internal cooling of the airfoils is bled off from the compressor and thus not used in the combustor to generate the hot gas flow.

Prior art turbine rotor blades have internal cooling circuits that include multiple pass serpentine flow cooling channels that flow either in an aft direction or a forward direction to provide high levels of cooling to the airfoil. Prior art serpentine circuits include 3-pass serpentines and 5-pass serpentines and are typically limited to these odd number of passes due to the source of the pressurized cooling air being supplied to the blade root section and that it is desirable to form the last leg of the serpentine with a flow direction towards the tip.

BRIEF SUMMARY OF THE INVENTION

It is an object of the present invention to provide for a turbine rotor blade with integrated platform cooling and airfoil cooling.

It is another object of the present invention to provide for a turbine rotor blade without the need for turn manifolds or cover plates.

It is another object of the present invention to provide for a turbine rotor blade with a single cooling flow entrance for the cooling air used for the entire airfoil and platform cooling passages.

It is another object of the present invention to provide for a turbine rotor blade with leading edge impingement cooling that then uses the cooling air to provide cooling for the blade tip section cooling for a better use of the cooling air and to yield more producible leading edge impingement cross-over hole size for casting.

It is another object of the present invention to provide for a turbine rotor blade with a higher creep life capability than the rotor blades of the prior art.

The above objectives and more are achieved in the turbine rotor blade cooling circuit of the present invention which includes a 5-pass aft flowing serpentine flow cooling circuit for the blade airfoil and an integrated blade platform cooling circuit that is connected in series with the 5-pass serpentine circuit. A single cooling air supply passage in the leading edge region provides for the cooling air flow for both the airfoil and the platform cooling circuits. Cooling air flows through the second leg of the 5-pass serpentine circuit and then through a cooling circuit in a first section of the platform, and from the platform into the third leg of the 5-pass serpentine circuit. Cooling air from the fourth leg of the 5-pass serpentine circuit then flows through a cooling circuit in a second section of the platform and then into the fifth leg of the 5-pass serpentine circuit. Thus, a single cooling air passage is formed to provide cooling for the airfoil through a multiple pass serpentine flow circuit with the diversion of the serpentine flow circuit through sections of the platform before rejoining the serpentine circuit to provide cooling for the entire blade. Less cooling air flow is required which results in an increase in the efficiency of the engine. Also, the blade creep life capability is increased because of the total cooling air flow passing through the entire blade.

DETAILED DESCRIPTION OF THE INVENTION

Figure 1:
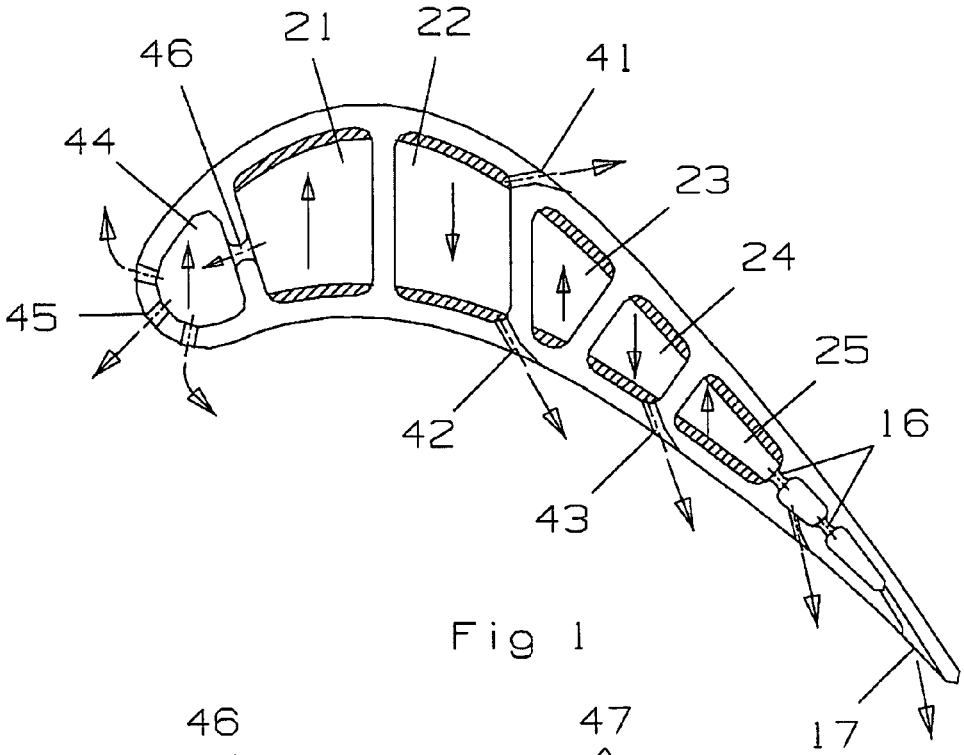
FIG. 1 shows a cross section top view the turbine rotor blade with a 5-pass serpentine flow cooling circuit of the present invention.
Figure 2:
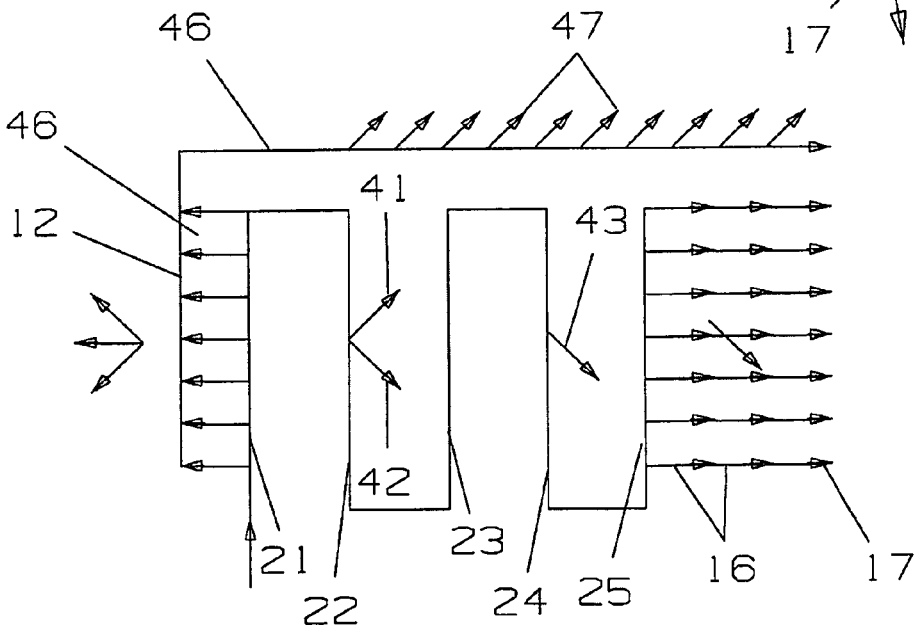
FIG. 2 shows a flow diagram of the cooling circuit of the present invention of FIG. 1.

FIGS. 1 and 2 shows a 5-pass serpentine flow cooling circuit for a turbine rotor blade of the present invention. This circuit includes an aft flowing 5-pass serpentine circuit with a first leg 21 forming the supply channel for the cooling circuit located adjacent to a leading edge impingement cavity 44 that supplies cooling air through metering holes 46 into the impingement cavity 44 that discharges film cooling air through a showerhead arrangement of film holes 45 on the leading edge of the blade. From the first leg 21, the cooling air flows along the serpentine circuit and into the fifth leg 25 that is located along the trailing edge region and then into multiple impingement holes 16 formed within the trailing edge region before discharging the spent cooling air out through a row of exit slots or holes 17 arranged along the trailing edge region, in this case on the pressure side wall of the airfoil. The 5-pass forward flowing serpentine flow cooling circuit also includes a second leg 22, a third leg 23 and a fourth leg 24 that connects in series to form the serpentine flow path through the blade mid-chord section. The second leg 22 includes a row of pressure side film cooling holes 42 and a row of suction side film cooling holes 41. The fourth leg 24 also includes a row of film cooling holes 43 that discharge onto the pressure side wall.

Figure 3:
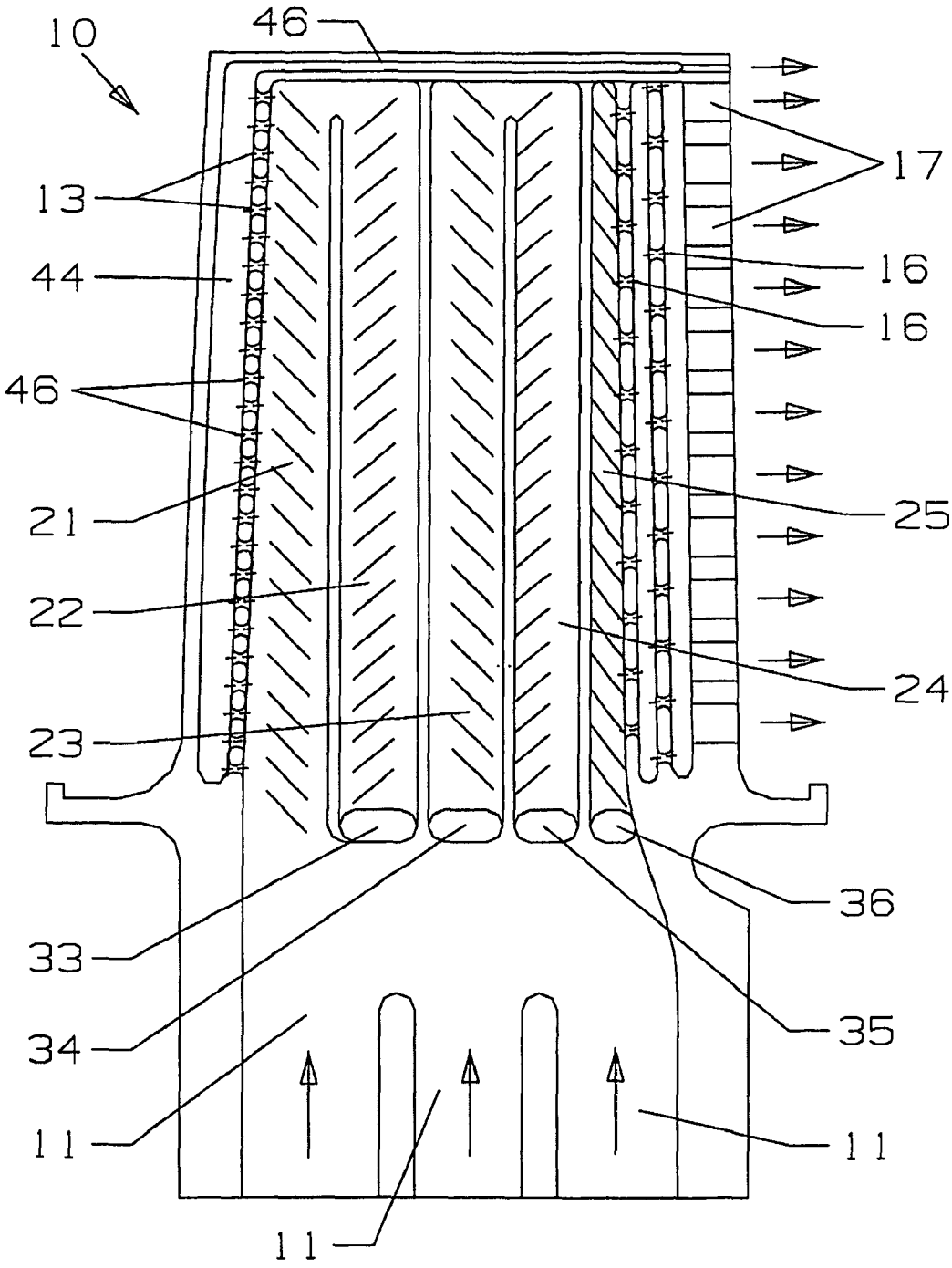
FIG. 3 shows a cross section side view of the turbine rotor blade cooling circuit of the present invention.

The blade tip is cooled by bleeding off some of the cooling air from the end of the leading edge impingement cooling cavity 44 as seen in FIGS. 2 and 3 and passing the remaining cooling air along a blade tip cooling channel 46 formed between the blade tip floor and the internal serpentine flow cooling circuit. Blade tip cooling holes 47 are connected to the blade tip cooling channel 46 and extend along the blade tip from near the leading edge to near the trailing edge and discharge the cooling air from the blade tip channel 46.

The turbine rotor blade with integrated airfoil and platform cooling circuit of the present invention is shown in FIGS. 1-4 where FIG. 3 shows a cross section side view of the blade. The blade 10 includes a root section that forms cooling air supply passages 11 for the airfoil and platform. The cooling air circuit includes a 5-pass aft flowing serpentine cooling circuit with a first leg or channel 21 located adjacent to the leading edge region of the airfoil, a second leg 22, a third leg 23, a fourth leg 24 and a fifth leg 25 located adjacent to the trailing edge region of the airfoil. The cooling air flows through the 5-pass serpentine channels in series.

Figure 4:
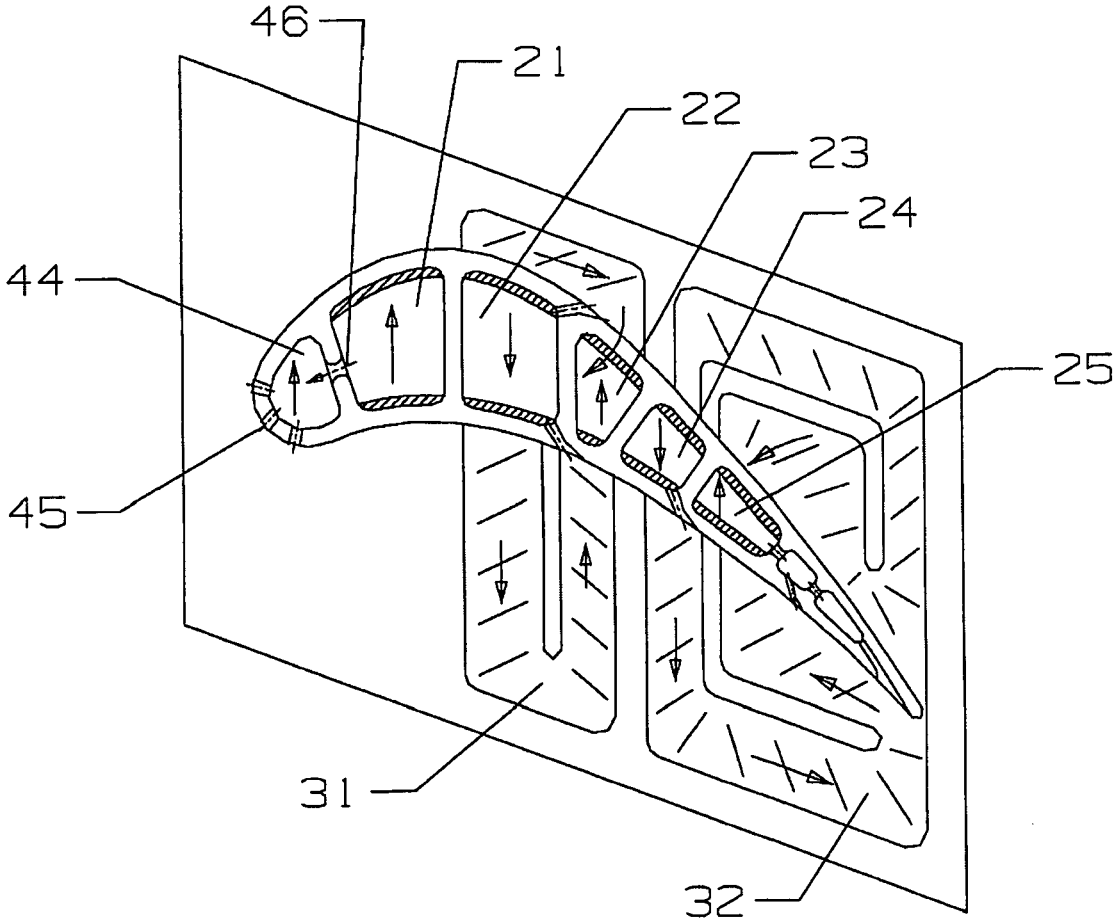
FIG. 4 shows a cross section top view of the turbine blade airfoil and platform cooling circuit of the present invention.

A leading edge impingement cavity 44 is formed along the leading edge and is connected to the first leg 21 through a row of metering and impingement holes 46 to supply cooling air to the impingement cavity 44. A showerhead arrangement of film cooling holes 45 is connected to the impingement cavity 44 as seen in FIG. 4 to provide film cooling for the leading edge. The blade tip section cooling circuit 46 is connected to the top end of the impingement cavity 44 to provide cooling air for the blade tip. The blade tip cooling circuit can be a chordwise extending serpentine flow channel that discharges the cooling air through an exit hole along the trailing edge. The blade tip channel 44 also provides for cooling along the pressure and suction sides of the blade tip.

The blade platform is cooled by two separate circuits as seen in FIG. 4 with a mid-section platform circuit 31 and an aft section platform circuit 32. Cooling air from the end of the second leg 22 in the serpentine flow circuit flows out through a hole 33 and into the mid-section platform circuit 31 in two directions, one toward the pressure side and the other toward the suction side as seen in FIG. 4. The spent cooling air from the mid-section platform circuit 31 than flows through another hole 34 and into the bottom of the third leg 23 of the 5-pass serpentine circuit. The cooling air then flows up the third leg 23 and turns 180 degrees at the blade tip and down the fourth leg 24. The second leg 22 includes a hole 33 on the pressure side to connect to the mid-chord platform circuit on the pressure side, and another hole 33 on the suction side to connect to the mid-chord platform circuit on the suction side. Thus, cooling air from the second leg 22 flows out through two holes 33 and into the two circuit of the mid-chord platform cooling circuit. Each of the legs 22-25 includes two holes, one on the pressure side and one on the suction side of the leg.

At the end of the fourth leg 24, the cooling air then flows out another hole 35 and into the aft section platform circuit 32, where the cooling air flows in a serpentine path around the pressure side and suction side of the platform. The spent cooling air in the aft section platform circuit 32 then flows into another hole 36 and into the fifth leg 25 of the 5-pass serpentine circuit of the airfoil section. Thus, the cooling air flows through both the airfoil 5-pass serpentine circuit and the two platform cooling circuits in series to reuse the same cooling air for both the airfoil and the platform cooling.

As seen in FIG. 3, the spent cooling air in the fifth leg 25 passes through multiple impingement holes 16 and then out through exit holes or slots 17 formed along the trailing edge of the airfoil to provide cooling to the trailing edge region. Double or triple impingement within the trailing edge region can be used, and the exit slots 17 can be formed along the pressure side wall of the trailing edge region.

The major design features of the cooling circuit of the present invention are as follows. The 5-pass aft flowing serpentine circuit is used for the blade airfoil section. An integrated blade platform cooling circuit with the airfoil cooling circuit. Two serpentine tip turns are used. Skew trip strips are used for all of the serpentine flow cooling passages in the airfoil and the platform circuits. Cooling air for the airfoil and the platform sections are delivered through the airfoil leading edge passage. Trailing edge discharge holes or slots are used to discharge the spent cooling air and to provide cooling for the trailing edge region.

Improvement for the entire blade cooling system can be achieved by the integration of the blade platform cooling flow into the 5-pass serpentine flow cooling circuit of the airfoil section, and thus the total cooling air can be fully utilized. The cooling air is supplied to the airfoil leading edge region first to provide cooling for the blade leading edge section. Thus, the highest pressure and coolest temperature cooling air is used to cool the hottest section of the blade first. The cooling air then flows aft-ward to make a first tip turn within the blade outer diameter section for the cooling of the airfoil tip section. The cooling air then flows downward toward the blade root section. The cooling air then makes the root turn within the blade platform to provide cooling for the platform section. The cooling air then channels through the airfoil mid-chord flow channel for cooling of the blade mid section. The spent cooling air then makes a second tip turn within the blade tip region and is channeled into the fourth leg of the 5-pass serpentine flow circuit.

Another feature is the re-use of some of the impingement cooling air from the leading edge impingement cavity for passing along the blade tip cooling channel to provide cooling for the blade tip. the impingement cooling air that is not discharged through the showerhead arrangement of film cooling holes 45 will flow into the blade tip cooling channel 46 to be used in this portion of the blade.

The spent cooling air from the fourth leg then makes a second root turn within the blade platform trailing edge region. A portion of the cooling air can be bled off from the serpentine flow channel through the fifth leg. Cooling air is bled off from the fifth leg of the serpentine flow circuit periodically for the cooling of the airfoil trailing edge. A portion of the cooling air is then discharged from the fifth leg to provide cooling for the blade tip corner.

Major design features and advantages of the present invention over the prior art 5-pass aft flowing serpentine design are described below. The current serpentine cooling flow circuit utilizes the blade platform cooling for the entire airfoil cooling. Serpentine root turns are formed within the blade platform section and thus provides the cooling for the platform and eliminates the use of turn manifolds or cover plates. A single cooling flow entrance for the serpentine flow circuit provides for a robust cooling flow control capability for the integrated aft flowing serpentine circuit of the present invention. A 5-pass serpentine flow circuit with total cooling flow will yield higher creep life capability for the blade.

I claim the following:

1. A turbine rotor blade comprising:

a root section with a cooling air supply passage;

an airfoil section extending from the root section, the airfoil section having a pressure side wall and a suction side wall both extending between a leading edge and a trailing edge;

a platform with a platform cooling circuit;

a multiple pass aft flowing serpentine cooling circuit formed within the airfoil section to provide cooling for the airfoil section of the blade; and, the platform cooling circuit and the airfoil serpentine flow cooling circuit being connected in series such that the cooling air flowing through the airfoil serpentine circuit also flows through the platform cooling circuit.

2. The turbine rotor blade of claim 1, and further comprising:

the airfoil serpentine flow circuit includes a first leg located adjacent to a leading edge region of the airfoil, a second leg that flows toward the root section, and a third leg that flows toward a blade tip section; and, the platform cooling circuit includes an inlet connected to the second leg and an outlet connected to the third leg such that cooling air from the second leg flows through the platform cooling circuit and then into the third leg.

3. The turbine rotor blade of claim 2, and further comprising:

the airfoil serpentine flow circuit is a 5-pass serpentine flow circuit with a first leg located adjacent to a leading edge region of the airfoil and a fifth leg located adjacent to a trailing edge region of the airfoil; and, the platform cooling circuit includes an inlet connected to the fourth leg and an outlet connected to the fifth leg such that cooling air from the fourth leg flows through the platform cooling circuit and then into the fifth leg.

4. The turbine rotor blade of claim 1, and further comprising:

the airfoil serpentine flow circuit is a 5-pass serpentine flow circuit with a first leg located adjacent to a leading edge region of the airfoil and a fifth leg located adjacent to a trailing edge region of the airfoil;

the platform includes a mid section platform cooling circuit and an aft section platform cooling circuit;

the mid section platform cooling circuit connected to the second leg of the 5-pass serpentine circuit to supply cooling air and connected to the third leg to discharge cooling air from the mid-section platform cooling circuit; and, the aft section platform cooling circuit connected to the fourth leg of the 5-pass serpentine circuit to supply cooling air and connected to the fifth leg to discharge cooling air from the mid-section platform cooling circuit.

5. The turbine rotor blade of claim 4, and further comprising:

the mid-section platform cooling circuit and the aft section platform cooling circuit both include a pressure side platform cooling circuit and a suction side platform cooling circuit connected in parallel; and, the second leg, the third leg, the fourth leg and the fifth leg each includes two holes located adjacent to the platform section to connect to the platform cooling circuits.

6. The turbine rotor blade of claim 4, and further comprising:

a leading edge impingement cavity connected to the first leg of the serpentine flow cooling circuit through a row of metering and impingement holes; and, a showerhead arrangement of film cooling holes connected to the leading edge impingement cavity.

7. The turbine rotor blade of claim 6, and further comprising:

a blade tip cooling circuit connected to the leading edge impingement cavity.

8. The turbine rotor blade of claim 4, and further comprising:

a trailing edge region cooling circuit that includes multiple impingement cooling and exit holes to discharge spent cooling air from the airfoil; and, the trailing edge region cooling circuit being connected to the fifth leg of the serpentine flow cooling circuit.

9. The turbine rotor blade of claim 1, and further comprising:

the multiple pass serpentine flow cooling circuit extends from a platform section of the airfoil to the blade tip section of the airfoil.

10. The turbine rotor blade of claim 1, and further comprising:

the multiple serpentine flow channels extend across the airfoil form the pressure side wall to the suction side wall.

11. A process for cooling a turbine rotor blade, the turbine rotor blade including a platform and an airfoil extending from the platform, the airfoil being cooled by a serpentine flow cooling circuit, the process comprising the steps of:

passing pressurized cooling air through a first leg of the serpentine flow circuit in the airfoil adjacent to a leading edge region of the airfoil and toward a blade tip;

bleeding off a portion of the cooling air to provide impingement cooling for a leading edge of the airfoil;

turning the cooling air at the blade tip and flowing the cooling air toward the platform to provide cooling to this part of the airfoil;

diverting the cooling air from the serpentine flow circuit through the platform to provide cooling for the platform; and, passing the cooling air from the platform back into the serpentine flow circuit to flow toward the blade tip.

12. A process for cooling a turbine rotor blade of claim 11, and further comprising the steps of:

the steps of diverting the cooling air from the serpentine flow circuit and passing the cooling air from the serpentine flow circuit includes:

passing the cooling air through an airfoil pressure side platform cooling circuit and a suction side platform cooling circuit in parallel; and, merging the pressure side platform cooling air and the suction side platform cooling air in the cooling air flow of the serpentine flow circuit toward the blade tip.

13. A process for cooling a turbine rotor blade of claim 12, and further comprising the step of:

turning the airfoil cooling air through a second turn and flowing the cooling air through the airfoil toward the platform;

diverting the cooling air from the serpentine flow circuit through the platform to provide cooling for a second section of the platform; and, merging the cooling air from the platform back into the serpentine flow circuit to flow toward the blade tip.

14. A process for cooling a turbine rotor blade of claim 13, and further comprising the step of:

bleeding off the cooling air flowing toward the blade tip from the second section of the platform to provide multiple impingement cooling for the trailing edge region; and, discharging the impingement cooling air through exit holes.

15. A process for cooling a turbine rotor blade of claim 13, and further comprising the steps of:

passing the serpentine flow cooling air and the platform sections cooling air in an aft direction of the airfoil and platform.

16. A process for cooling a turbine rotor blade of claim 11, and further comprising the steps of:

bleeding off some of the leading edge impingement cooling air to provide film cooling for the leading edge of the airfoil; and, passing the remaining leading edge impingement cooling air along the blade tip to provide cooling for the blade tip.

* * * * *